United States Patent [19]

Heine

[11] 4,284,462

[45] Aug. 18, 1981

[54] AUTOMATIC STACKING APPARATUS FOR VARIABLE LENGTH TEXTILE FABRICS

[75] Inventor: Rolf Heine, Rinteln, Fed. Rep. of Germany

[73] Assignee: Herbert Kannegiesser GmbH. & Co., Vlotho, Fed. Rep. of Germany

[21] Appl. No.: 99,178

[22] Filed: Nov. 30, 1979

[30] Foreign Application Priority Data

Dec. 27, 1978 [DE] Fed. Rep. of Germany ..... 2856237

[51] Int. Cl.[3] ..... B32B 31/00

[52] U.S. Cl. ..... 156/350; 271/84; 271/219; 414/900

[58] Field of Search ..... 271/84, 85, 176, 213, 271/217, 219; 414/36, 900, 97; 156/360, 350; 223/1

[56] References Cited

U.S. PATENT DOCUMENTS 1270334 6/1918 Schumacher ..... 271/84
3729190 4/1973 Harris et al. ..... 271/176 X

FOREIGN PATENT DOCUMENTS 7317511 10/1973 Fed. Rep. of Germany .
2325469 12/1974 Fed. Rep. of Germany .

*Primary Examiner*—David A. Simmons
*Attorney, Agent, or Firm*—Sughrue, Mion, Zinn, Macpeak and Seas

[57] ABSTRACT

An apparatus for stacking glued textile fabrics has photocells 43, 44 for controlling the withdrawal movement of a stacking table 25 in dependence on the length of the fabrics. The stacking table moves in the same direction as a fabric piece until the trailing edge of the fabric no longer interrupts a light beam, whereupon the table returns to its original position to receive further pieces of fabric. The apparatus also includes clamping means 37, 38 to firmly hold the already stacked fabrics.

9 Claims, 2 Drawing Figures

AUTOMATIC STACKING APPARATUS FOR VARIABLE LENGTH TEXTILE FABRICS

BACKGROUND OF THE INVENTION

The invention relates to an apparatus for gluing textile fabrics, particularly those of outerwear clothing pieces, comprising a layout station, a hot pressing station, a cooling station and an automatic stacking device which has a stacking table mounted so that its height can be adjusted and it can also reciprocate along the operating direction of the apparatus.

Devices are known which have both discontinuous as well as continuous methods of operation, and have a conveyor belt by means of which the textile fabrics are conveyed from the layout station to and through the hot pressing station and the cooling station and are then led to an automatic stacking device. The automatic stacking device is disposed at the end of the conveyor belt and/or the cooling station and the stacking table thereof is movable therebeneath. In discontinuously operating devices the stacking table reciprocates in the operating cycle of the conveyor belt (German Utility Model No. 6,802,030).

In another known apparatus, the automatic stacking device is divided over the entire operating width of the apparatus into at least two adjacent operating areas. Each operating area has its own stacking device. The stacking devices of the operating areas are controllable both individually and in unison, whereby the control is accomplished by detectors disposed at the beginning of the operating areas. Each stacking device has, in addition to a height-adjustable stationary stacking table, a stack rake which can be moved forward and backward in the operating direction of the apparatus and which cooperates with a strip-off rake. These rakes are disposed above the stacking table and place the glued textile fabrics on the stacking table as they are delivered thereto by the conveyor belt of the apparatus. The separation of the stacking device into at least two adjacent operating areas improves the method of operation of the servicing personel (German Pat. No. 2,325,469).

In these known devices, during each stacking step the stack elements reciprocate along the distance needed for the longest textile fabrics to be glued, for example a front panel of a jacket. In gluing different length fabrics, and especially with small fabrics such as collars, the stacking elements performed a great deal of excess motion, which results in lost time. These devices also have no means for holding the stacked varying sized textile fabrics firmly in place so as to be free of shifting relative to each other and thus allow them to slip during the rapid movements of the stacking table. This limits the height to which the fabric can be stacked.

SUMMARY OF THE INVENTION

The basic objective of the invention is to create an apparatus of the above-described construction, the stacking device of which exhibits no lost time when stacking particularly small textile fabrics or fabrics of varying length, and which thus achieves a higher performance than the known devices. The stacking device should also enable operation in a multiple track mode, and the stacked textile fabric of various sizes is to be firmly held in place during the varying rapid movements of the stacking table while compensating for the shape of the stack.

The solution to the first portion of this objective is achieved by controlling the movement of the stacking table in the direction of conveyance in dependence on the length of the glued textile fabrics. According to the invention, during each stacking step, the stacking table need only travel that distance necessary to stack the respective textile piece presented, which eliminates lost motion time.

The varying lengths of textile fabric are held in place free of relative shifting at the desired elevation on the stacking table, while the shape of the stack is compensated for during the course of the rapid traveling movements of the stacking table in dependence on the length of such fabrics. This is possible because the table plate of the stacking table has a special multiple-element structure which can adapt to the shape of the stack, and the leading edges of all textile fabrics are clamped to the table plate immediately after being deposited on the stacking table.

DETAILED DESCRIPTION OF THE PREFERRED EMBODIMENT

Figure 1:
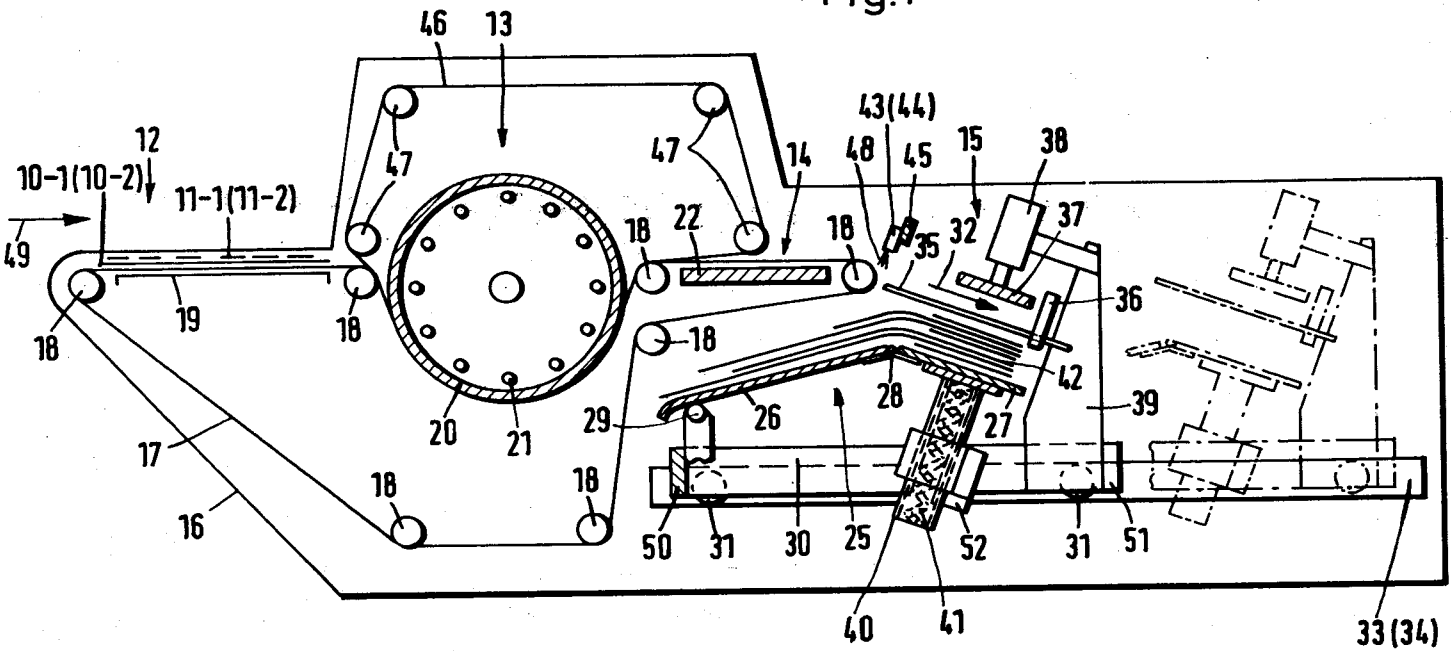
FIG. 1 is a longitudinal section through a continuously operating apparatus in which the stacking device is shown in two positions, this section corresponding to section line A–B in FIG. 2.

The apparatus shown in the drawings for continuously gluing textile fabrics 10-1 or 10-2 (outerwear material) and 11-1 or 11-2 (inserts) comprises a layout station 12, a hot pressing station 13, a cooling station 14 and a stacking device 15 arranged in sequence in a frame 16 in the conveying direction thereof (arrow 49).

To convey the textile fabrics 10-1 through 11-2 from the layout station 12 to and through the hot pressing station 13 as well as the cooling station 14, an endless conveyor belt 17 is provided which is driven and guided by rollers 18. The conveyor belt 17 is supported in the layout station by a table plate 19. The conveyor belt is guided around a portion of a cylinder 20 in the hot pressing station 13, which cylinder is heated by heating rods 21 arranged in the interior thereof. In the cooling station 14 the conveyor belt is guided to slide along a stationary cooling plate 22. A cover belt 46, which is driven and guided by rollers 47, also travels against and part way around the cylinder 20.

The stacking device 15 has two operational areas 23, 24 (FIG. 2) which lie next to each other in the conveying direction of the apparatus and have the same width. The total operating width of the stacking device 15 resulting from these two operational areas corresponds to the operating width of the apparatus in the vicinity of the preceding stations. The areas 23, 24 are formed in the same manner and have stacking tables 25 which travel in the direction of conveyance and back. The stacking table 25 has a traveling frame 30 including two cross supports 50, 51 and four rollers 31 which run in guide rails 33, 34. The stacking table is driven by known devices which are not shown in the drawings, such as pneumatic cylinders acted upon on both sides by compressed air. The table plate of the stacking table 25 is formed in two pieces. The two elements 26, 27 thereof are connected with each other in an articulated manner by a hinge 28 and have the approximate shape of a roof when in their unloaded position. These elements 26, 27 are mounted on the traveling frame 30 so that their position during the course of the stacking process can be altered in dependence on the height of the textile fabric 42 stacked thereon. The forward portion of the table plate element 27 is mounted on its underside so that its height on the traveling frame 30 can be adjusted, and has guide sleeves 40 and a compression spring 41 disposed therein. The free end of the other element 26 of the table plate lies on two guide rollers 29. A clamping plate 37, which is also mounted in a heightadjustable manner, is disposed above the element 27 and includes guide and drive elements 38 on a mounting bracket 39, which in turn is connected to the traveling frame 30. The clamping plate 37 and the stacking table 25 or the element 27 of the table plate thereof are further disposed so that the lowest position of the height-adjustable clamping plate 37 is identical with the highest position of the stacking table 25 or the upper edge of the stack 42 of textile fabric lying thereon. The stacking table 25 is automatically retained after each lowering thereof by the clamping plate 37 by means of a detent 52 (FIG. 1). This detent can be released electrically by a lever which is not shown in the drawings, for example when the stacking table has been unloaded in the position shown by the broken line in FIG. 1. Also disposed above the stacking table 25 is a stacking rake 35 which reciprocates in the direction of arrow 32 and cooperates with a stripping rake 36. A photoelectric detector 43 or 44 is disposed on a cross support 45 of the frame 16 at the beginning of each operational area 23, 24 of the stacking device 15, namely between the end of the cooling station 14 and the beginning of the stacking rake 35, to control the traveling movement of the stacking table in dependence on the length of the glued textile fabrics.

The apparatus also includes further known elements and devices (not shown) which are necessary to operate it, such as for example additional photoelectric and/or mechanical detectors to control the movements of the stacking rake 35 and the clamping plate 37.

In operation, the textile fabrics 10-1 through 11-2 placed on the conveyor belt 17 in the layout station 12 by the operator apparatus are glued to each other in the hot pressing station 13, cooled in the cooling station 14 and delivered to the automatic stacking device 15. The glued fabrics first slide onto the stacking rake 35. As they do so the front edge thereof activates a photoelectric detector (not shown) in the vicinity of the stripping rake 36, which results in the stacking rake 35 being moved in the direction of arrow 32. This places the forward portion of the fabric on the element 27 beneath the rake 35 and parallel thereto. Immediately thereafter, the clamping plate 37 is pressed onto the section of the fabric lying on the element 27 of the table plate, which is thereby lowered by the thickness of the clamped textile fabric and retained in this position by the detent 52. Once this has taken place and the light beam 48 of the photoelectric detector 43 or 44 is still interrupted by the rear portion of the clamped textile fabric, i.e. when the clamped textile fabric is longer than the distance between the stripping rake 36 and the light beam 48, the stacking table 25 is moved in the direction of arrow 49 until the light beam 48 is no longer interrupted, for example into the final position shown in FIG. 1 by broken lines. The restoration of the light beam 48 begins the return movement of the stacking table back to its original position. Once this position is reached the clamping plate 37 and the stacking rake 35 are also immediately moved back to their original positions. The stacking device 15 is then ready to stack a further piece of textile fabric.

In the course of the further stacking steps the position of the elements 26 and 27 of the table plate of the stacking table 25 is repeatedly changed by the clamping plate 37 pressing down on the element 27 with the stacked textile fabrics thereon. The element 26 of the table plate therefore approaches an almost horizontal position. If a stack of the textile fabrics, for example the stack 42 in FIG. 1, is to be removed from the stacking device 15, then the stacking table 25 moves back into the final position shown by the broken line in FIG. 1. In this position the stacked textile fabrics 42 may be removed by the operator after the stacking rake 35 is first moved in the direction of arrow 32 and the clamping plate 37 is placed in its uppermost position.

Figure 2:
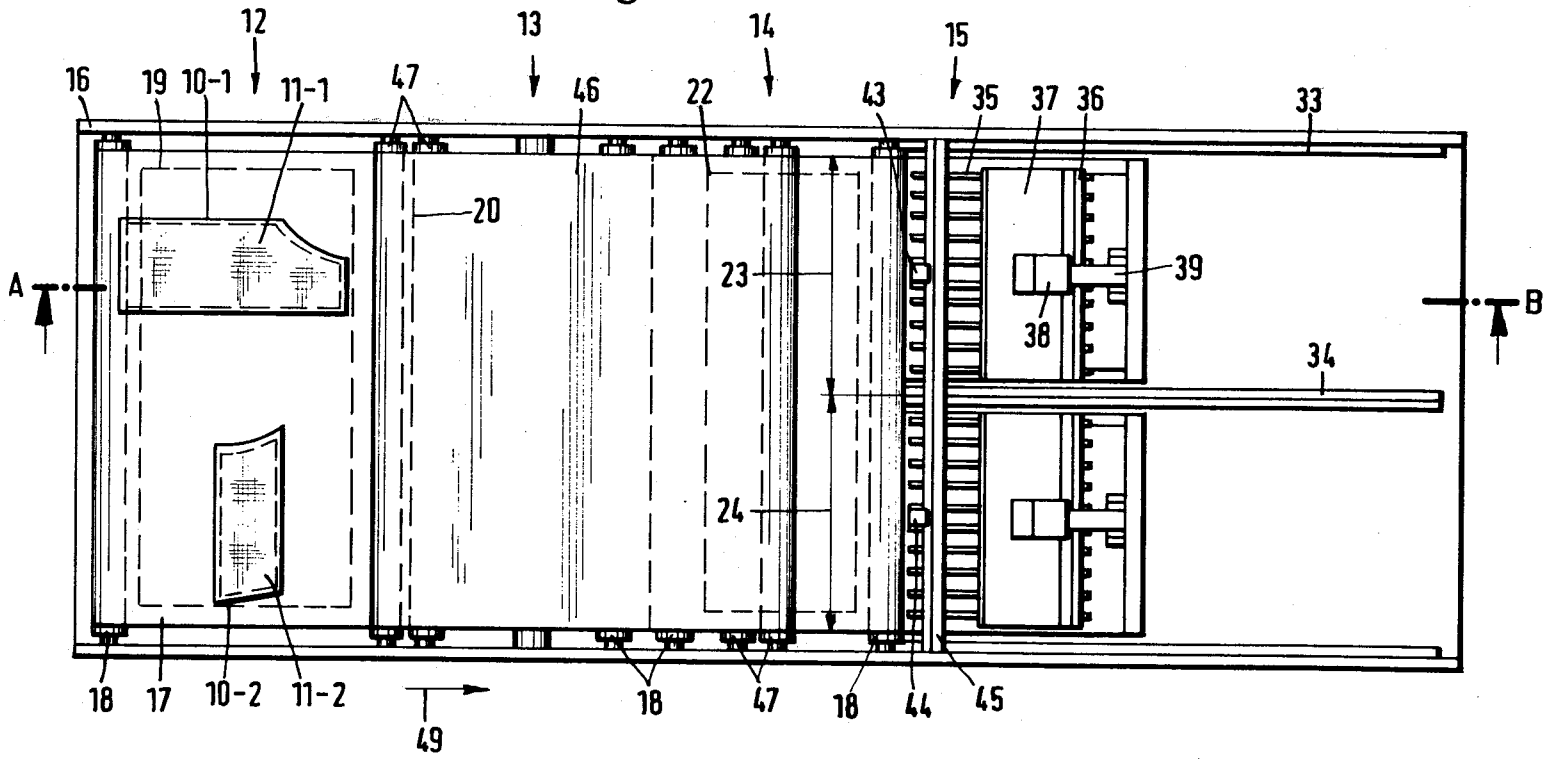
FIG. 2 is a top view of the apparatus according to FIG. 1.

From the above description it is clear that glued textile fabrics which are smaller than the distance between the stripper rake 36 and the light beam 48, which distance in the apparatus shown in FIGS. 1 and 2 is approximately 200 mm, can be stacked without moveing the stacking table 25, which also has a favorable effect on the performance of the apparatus

What is claimed is:

1. An apparatus for gluing and stacking textile fabric pieces, comprising:

a feeding station, a hot pressing station, a cooling station and an automatic stacking device for stacking together the glued textile fabrics, said stacking device including a stacking table having a stacking plate and being reciprocally movable and adjustable in height, a height adjustable clamping plate disposed above said stacking table and being reciprocally movable with said table, said clamping plate being raised to allow a textile fabric piece to be delivered to said stacking table, and being lowered to clamp a leading edge of said textile fabric piece on a front portion of said table, whereby a plurality of textile fabric pieces may be stacked, each of the leading edges of said pieces being clamped, one on top of the other, by said clamping plate.

2. Apparatus according to claim 1, wherein said stacking plate includes at least two elements hingedly connected to one another.

3. An automatic stacking apparatus for variable length textile fabric pieces, comprising:

(a) a vertically adjustable stacking table, (b) means for conveying individual pieces of textile fabric onto the table, (c) clamping plate means for clamping a leading edge of each of the textile fabric pieces on the table, said clamping plate being lifted to allow a textile fabric piece to be delivered to said stacking table, and then being lowered to clamp together the leading edges of each of the textile fabric pieces located on the table, (d) means proximate an end of the conveying means adjacent the table for detecting the presence of a textile fabric piece, and (e) means for moving the table and clamping means in the direction of conveyance when the detecting means still senses the presence of a clamped textile fabric piece on the table to thereby withdraw a trailing edge of said clamped textile fabric piece from the conveying means.

4. Apparatus for gluing textile fabrics, particularly those of outerwear clothing items, comprising a layout station, a hot pressing station, a cooling station and an automatic stacking table for the glued textile fabrics, said stacking table being adjustable in height and reciprocatable in the operating direction of the apparatus, said stacking table (25) having a table plate comprising at least two elements (26,27) which are hingedly connected with each other and which are disposed one behind the other in the operating direction of the apparatus (arrow 49); and a height adjustable clamping plate for (37) pressing against the element (27) of the table plate lying forward in the operating direction (arrow 49).

5. Apparatus according to claim 4, further comprising means for detecting the length of said glued textile fabrics disposed at the beginning of said stacking device (15) to control the movement of said stacking table (25) in dependence on the length of the glued textile fabrics.

6. Apparatus according to claim 4, wherein said elements of said table plate are connected with each other to approximate a roof shape and are mounted such that the positions of said elements can be changed during stacking in dependence on the height of the stack of textile fabrics lying thereon.

7. Apparatus according to claim 4, wherein the height of the stacking table (25) can be adjusted by means of the height-adjustably mounted clamping plate (37) and a compression spring (41) disposed therebeneath.

8. Apparatus according to claim 7, wherein the lowest position of said clamping plate (37) coincides with the highest position of said stacking table (25) when empty, and with the upper edge of any stack of textile fabric lying thereon.

9. Apparatus according to claim 7, wherein said stacking table is retained in position by detent means (52) after each lowering of said stacking table.

* * * * *